US006699068B2

(12) United States Patent
Wu

(10) Patent No.: US 6,699,068 B2
(45) Date of Patent: Mar. 2, 2004

(54) STACKED CONNECTOR ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/293,128

(22) Filed: Nov. 12, 2002

(65) Prior Publication Data

US 2003/0119345 A1 Jun. 26, 2003

Related U.S. Application Data

(63) Continuation-in-part of application No. 10/122,099, filed on Apr. 12, 2002, now Pat. No. 6,612,867, and a continuation-in-part of application No. 10/033,263, filed on Dec. 26, 2001, now Pat. No. 6,554,641.

(51) Int. Cl.[7] ..... H01R 13/60

(52) U.S. Cl. ..... 439/541.5; 439/79; 439/594; 439/540; 439/637; 439/108

(58) Field of Search ..... 439/541.5, 540, 439/79, 567, 608, 637, 947, 594, 80–82, 108, 701

(56) References Cited

U.S. PATENT DOCUMENTS 5,336,109 A * 8/1994 Hillbish et al.
5,634,819 A * 6/1997 Pan et al.
5,919,063 A * 7/1999 Wang
6,033,258 A 3/2000 Huang et al.
6,146,194 A * 11/2000 Lok
6,179,651 B1 * 1/2001 Huang
6,354,875 B1 3/2002 Wu

* cited by examiner

*Primary Examiner*—Anthony Dinkins
*Assistant Examiner*—Nguyen T. Ha
(74) *Attorney, Agent, or Firm*—Wei Te Chung

(57) ABSTRACT

A stacked connector assembly (10) includes a first connector (12) and a second connector (14) vertically stacked on the first connector. The first connector includes a first housing (16) and a number of first terminals (20) arranged in the first housing. The second connector includes a second housing (51), a number of second terminals (58) received in the second housing and a grounding member (78) attached to a rear portion of the second housing. The grounding member has a front engaging portion (810) projecting forwardly beyond the second housing for mating with a corresponding ground contact of a complementary electrical connector and a base portion (80) projecting rearwardly beyond the second housing. A spacer (36) attached to a rear end of the stacked connector assembly has an upper portion (361) receiving the second terminals therethrough and a lower portion (362) receiving the first terminals therethrough.

15 Claims, 9 Drawing Sheets

STACKED CONNECTOR ASSEMBLY

CROSS-REFERENCES TO RELATED APPLICATIONS

This application is a continuation-in-part of U.S. patent application Ser. No. 10/122,099 filed on Apr. 12, 2002 now U.S. Pat. No. 6,612,867 and entitled "STACKED CONNECTOR ASSEMBLY", and a continuation-in-part of U.S. patent application Ser. No. 10/033,263 filed on Dec. 26, 2001 now U.S. Pat. No. 6,554,641 and entitled "STACKED CONNECTOR ASSEMBLY", which are invented by the same inventor and assigned to the same assignee as this application and which are hereby fully incorporated by reference.

BACKGROUND OF THE INVENTION

1. Field of the Invention

The present invention generally relates to a stacked connector assembly, and more particularly to a stacked Single Connector Attachment (SCA-2) connector assembly.

2. The Related Arts

SCA-2 connectors provide a standard interface between Small Computer System Interface (SCSI) disk drives, Fiber Channel disk drives, Gigabit Interface Converter (GBIC) modules and back-plane systems. The SCA-2 connectors conform to the Small Form Factor (SFF) standard established by the Small Form Factor Committee, and can be classified into 3 types, i.e., 20-pin, 40-pin and 80-pin SCA-2 connectors according to different numbers of terminals thereof. The 20-pin SCA-2 connectors each have 20 terminals and are used with GBIC modules to connect with fiber channel. The 40-pin SCA-2 connectors each have 40 terminals and are used with 3.5" Fiber Channel disk drives. The 80-pin SCA-2 connectors each have 80 terminals and are used with 3.5" SCSI disk drives. Such connectors are used in high speed data transmission applications, so it is necessary and important to provide such connectors with shielding or grounding means for protection against Electromagnetic Interference (EMI) and Electrostatic Discharge (ESD). One of such connectors is shown in U.S. Pat. No. 6,354,875 issued to the same inventor as the present invention on Mar. 12, 2002.

Furthermore, to save the occupied area of the printed circuit board on which electrical connectors are mounted, the electrical connectors, such as SCA-2 connectors are configured in a stacked fashion before mounting to the printed circuit board. These connectors are generally called "stacked connector assemblies". One stacked connector assembly is shown in U.S. Pat. No. 6,033,258 issued to Huang et al. on Mar. 7, 2000. However, grounding means is assembled into an insulative housing of the electrical connector of Huang et al. with the use of additional fastening devices, such as screws, nuts and pegs, whereby the assembly process of the grounding means is troublesome and the manufacturing cost of the stacked connector assembly is also increased.

Therefore, an improved stacked connector assembly is necessary to overcome the disadvantages of the prior art.

SUMMARY OF THE INVENTION

An object of the present invention is to provide a stacked connector assembly which has grounding means.

Another object of the present invention is to provide a stacked connector assembly, connectors of which can be easily secured together.

To achieve the above objects, a stacked connector assembly in accordance with the present invention comprises a first connector and a second connector vertically stacked on the first connector. The first connector comprises a first housing and a plurality of first terminals. The second connector comprises a second housing having a bottom face and a plurality of second terminals. Each housing comprises two arms extending rearward from opposite ends thereof. Each arm of the second housing is stacked on the corresponding arm of the first housing. A grounding member retained in the second housing has a front engaging portion projecting forwardly beyond the second housing and a base portion projecting rearwardly beyond the second housing. A spacer has an upper portion defining a plurality of openings therethrough and a lower portion defining a plurality of openings therethrough. The upper portion is retained between the rearward-extending arms of the second connector with the second tails of the second terminals extending through the corresponding openings. The lower portion is retained between the rearward-extending arms of the first housing with the first tails of the first terminals extending through the corresponding openings.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
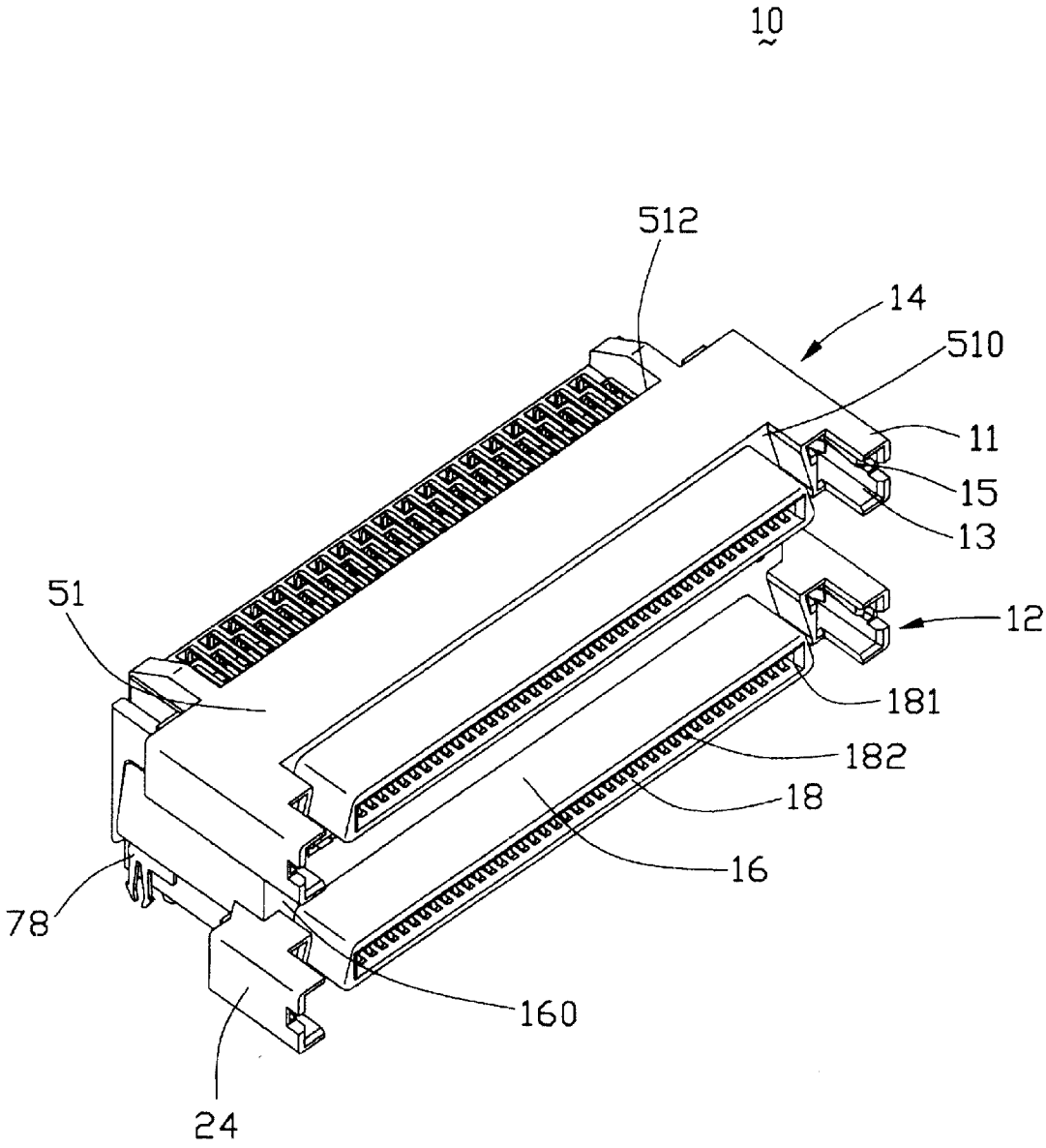
FIG. 1 is a perspective view of a stacked connector assembly in accordance with the present invention.
Figure 2:
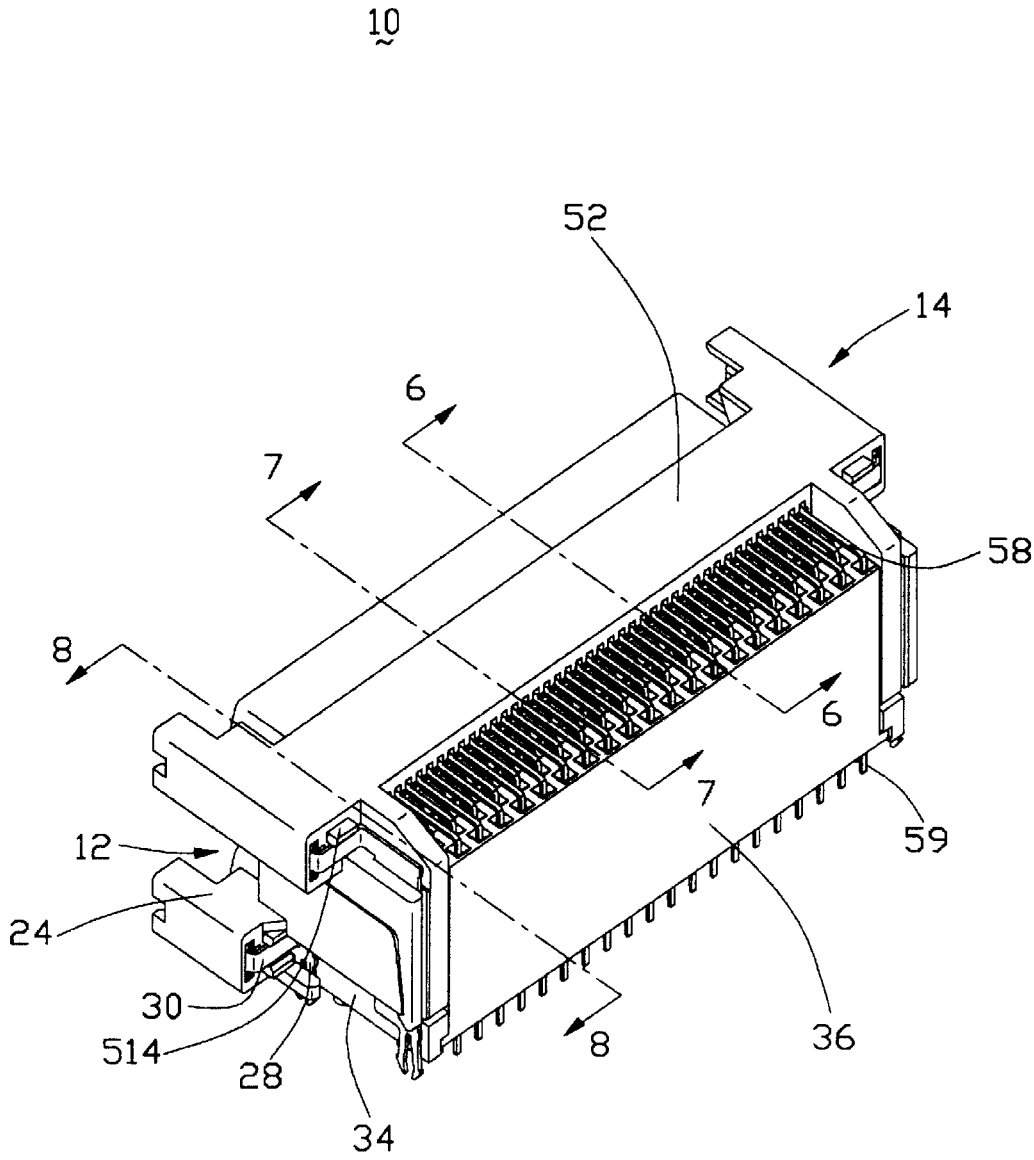
FIG. 2 is a view similar to FIG. 1, but taken from a different perspective.
Figure 3:
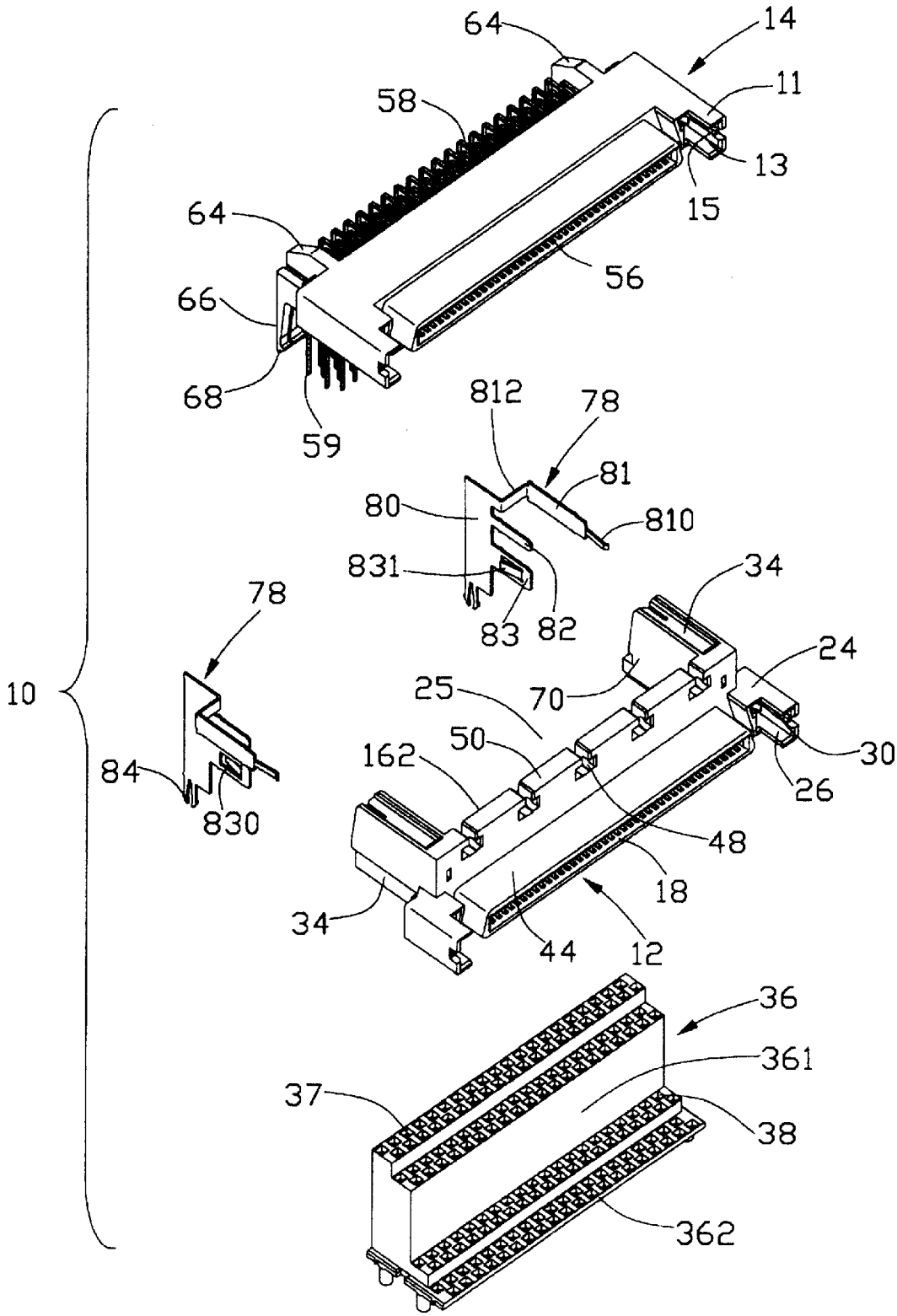
FIG. 3 is an exploded view of FIG. 1.
Figure 4:
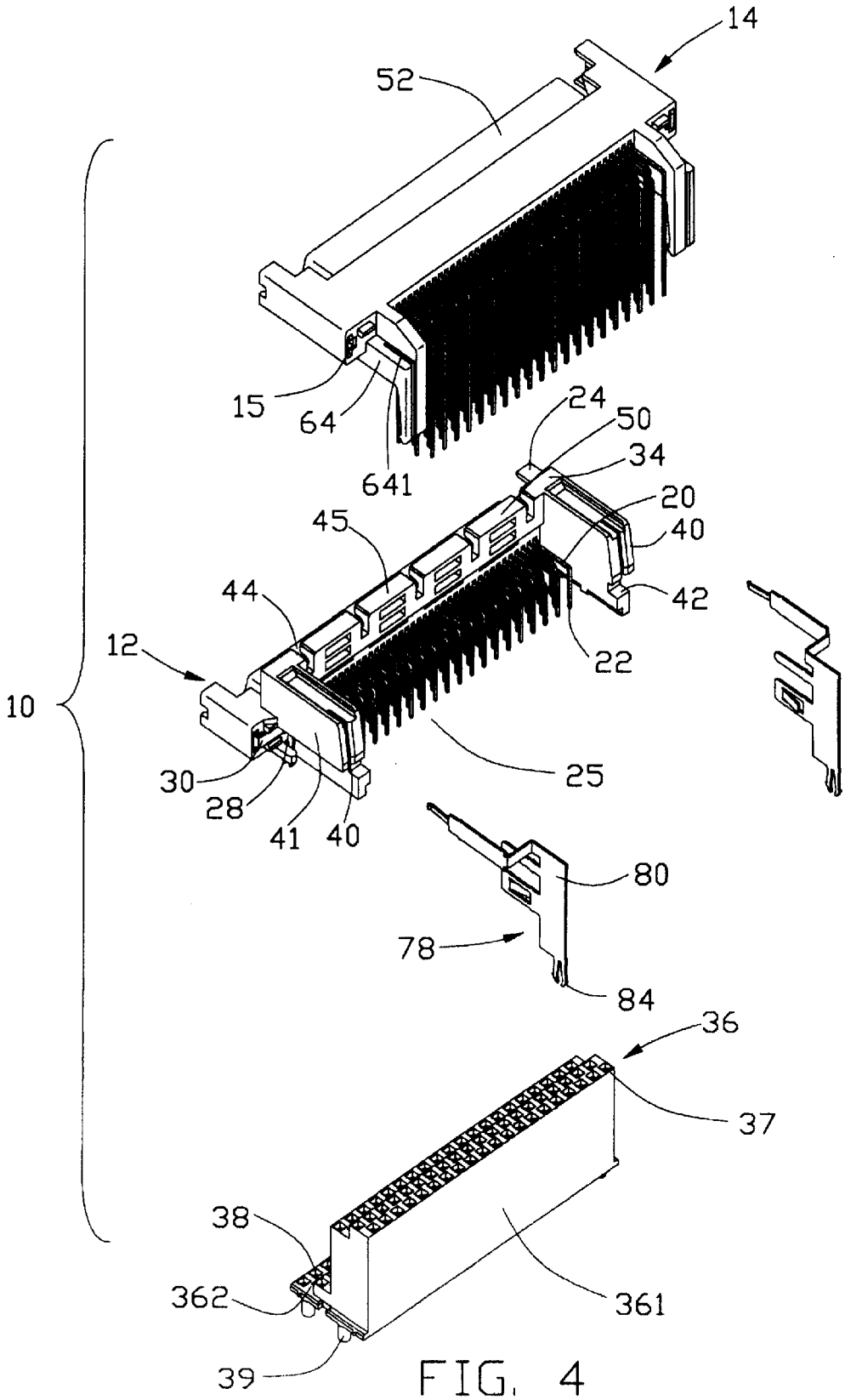
FIG. 4 is an exploded view of FIG. 2.

With reference to the drawings and particularly to FIGS. 1–4, a stacked SCA-2 receptacle connector assembly 10 constructed in accordance with the present invention, comprises a first (lower) connector 12, a second (upper) connector 14 vertically stacked on the first connector 12, and a spacer 36.

The first connector 12 comprises a first elongated housing 16, a plurality of first terminals 20 retained in the first housing 16 and a board lock 28 attached to the first housing 16. The first housing 16 has a top face 44, a front face 160 and a rear face 162 opposite to the front face 160. The first housing 16 is formed with a lengthwise-extending rib 45 extending upwardly from the top face 44 thereof and defining a plurality of spaced sockets 48 therein. The rib 45 has a flat top surface 50. A mating portion 18 extends forwardly from the front face 160 of the first housing 16 and defines a cavity 181 for receiving a first mating connector of a complementary SCA-2 stacked connector assembly (not shown) and a plurality of first passageways 182 arranged along inner surfaces thereof and communicating with the cavity 181. The first housing 16 has two forward-extending arms 24 extending from opposite ends thereof in a forward direction. The mating portion 18 is located between and spaced from the forward-extending arms 24. Each forward-extending arm 24 defines a guide channel 26 for guidingly receiving a complementary guidepost of the first mating connector.

The first housing 16 also has two rearward-extending arms 34 extending rearwardly from the ends thereof and a space 25 defined between the rearward-extending arms 34. Each rearward-extending arm 34 defines a first, vertically-extending slit 40 in a rear end thereof. Each rearward-extending arm 34 comprises a side plate 42 at outer sides thereof and a flange 42 located above the bottom face 17 of the first housing 16. The flange 42 has a flat surface thereon.

First conductive terminals 20 are retained in corresponding first passageways 182 of the first housing 16 and are arranged along inner surfaces of the mating portion 18 for electrically engaging with corresponding terminals of the first mating connector. Each first terminal 20 has a first tail 22 extending from the rear face 162 into the space 25 of the first housing 16 and downwardly beyond a bottom face 17 of the first housing 16 for insertion into holes defined in a printed circuit board (not shown) to which the stacked connector assembly 10 is mounted.

Figure 6:
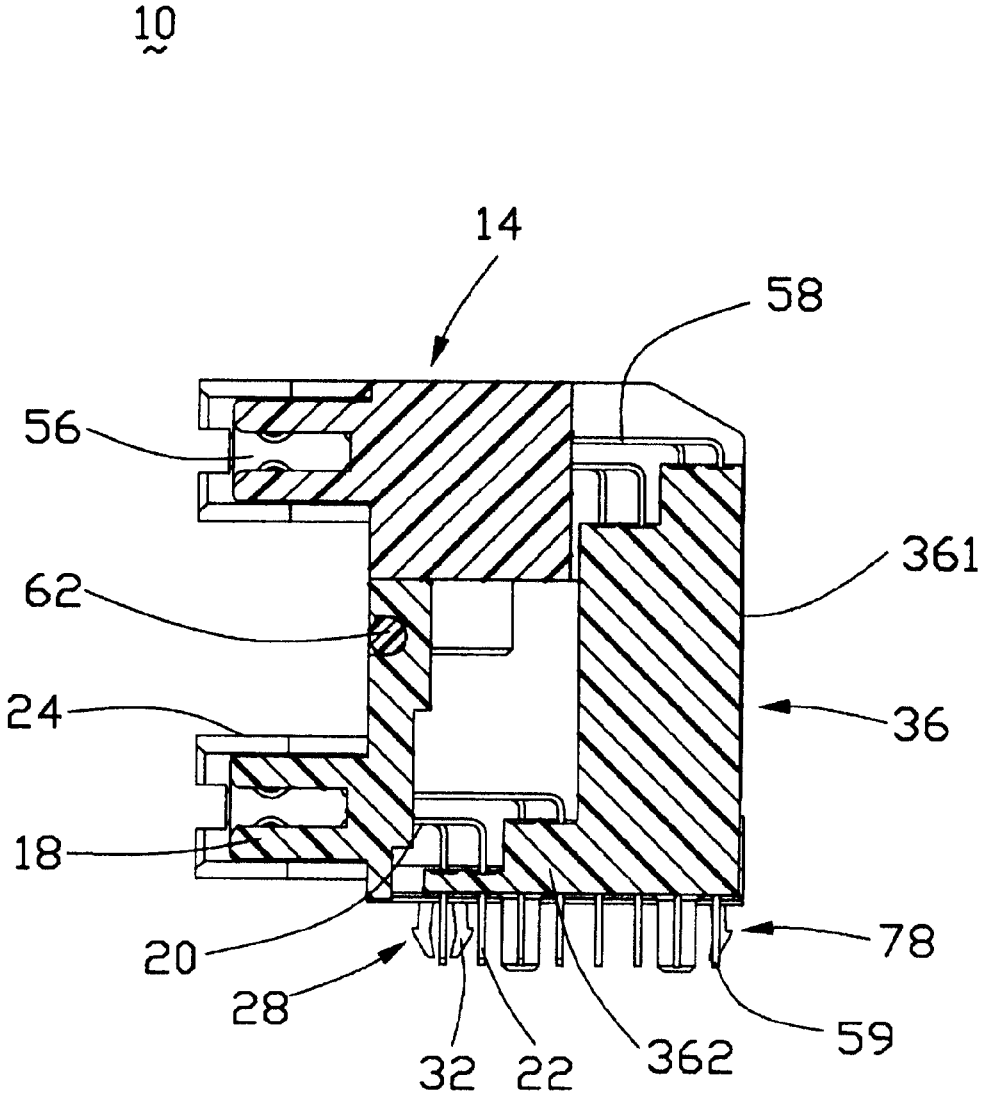
FIG. 6 is a cross-sectional view taken along line 6—6 of FIG. 2.
Figure 7:
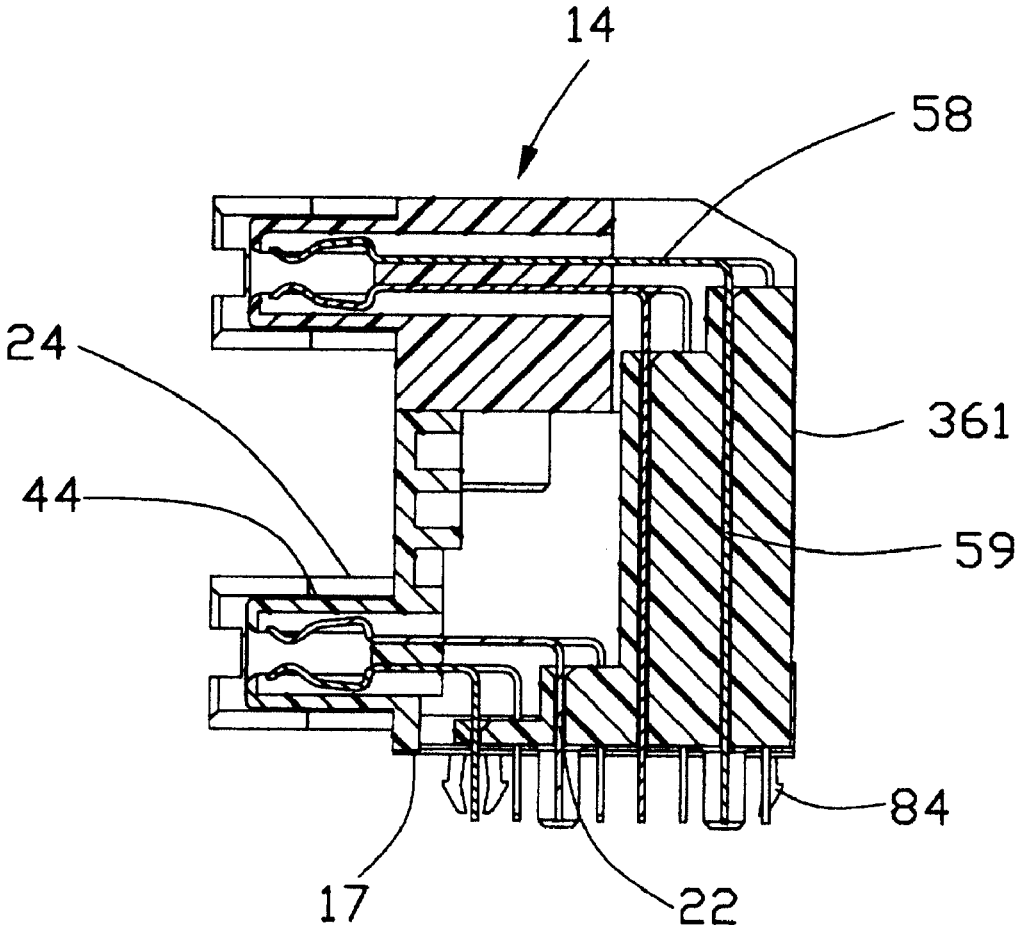
FIG. 7 is a cross-sectional view taken along line 7—7 of FIG. 2.
Figure 8:
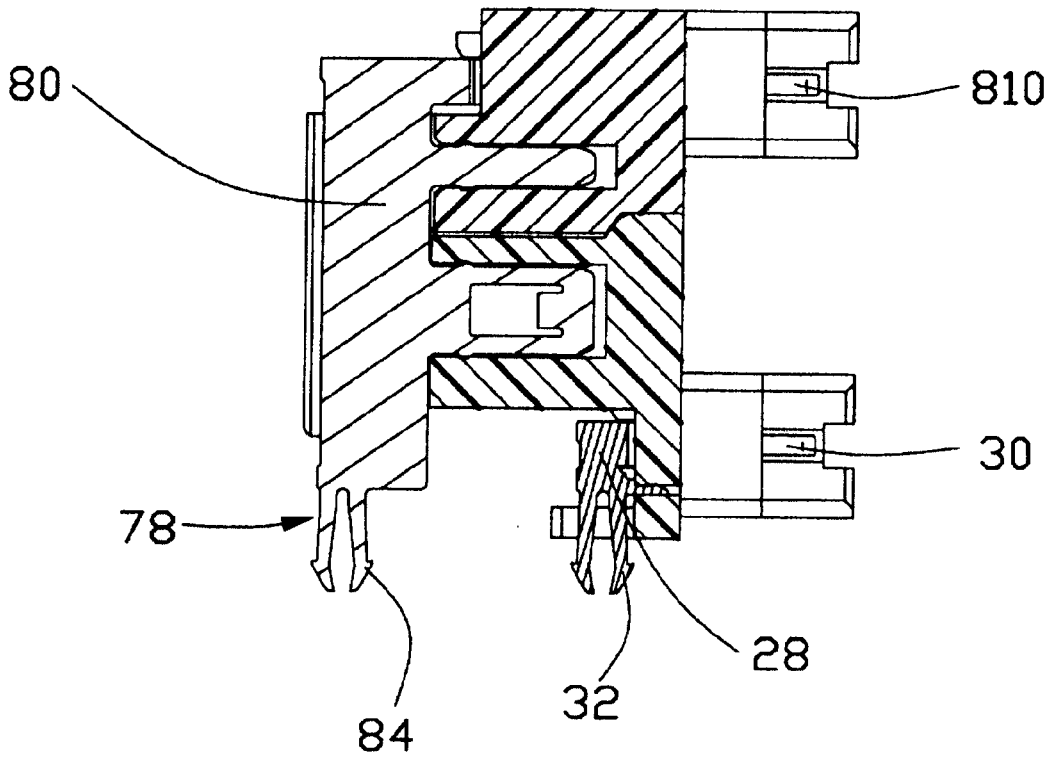
FIG. 8 is a cross-sectional view taken along line 8—8 of FIG. 2.

The board locks 28, made of conductive materials, are attached to the ends of the first housing 16 and each has an extension 30 extending into a corresponding guide channel 26 for electrically engaging a corresponding grounding member of the first mating connector. The board lock 28 has two spaced, resilient, barbed legs 32 (shown in FIG. 6) for interferentially fitting into a corresponding hole defined in the printed circuit board thereby retaining the stacked connector assembly 10 to the printed circuit board and electrically connecting with a grounding circuit of the printed circuit board. In other words, the board lock 28 of the present invention also functions as grounding means.

The second connector 14 comprises an elongate second housing 51, a plurality of second conductive terminals 58 retained in the second housing and a grounding member 78 attached to the second housing 51. The second housing 51 has a length substantially corresponding to the length of the first housing 16 of the first connector 12 and a bottom face 54 resting on the flat top surface 50 of the rib 45 of the first housing 16. The second housing 51 also has a front face 510 and a rear face 512. A mating portion 56 extends forwardly from the front face 510 of the second housing 51.

Figure 5:
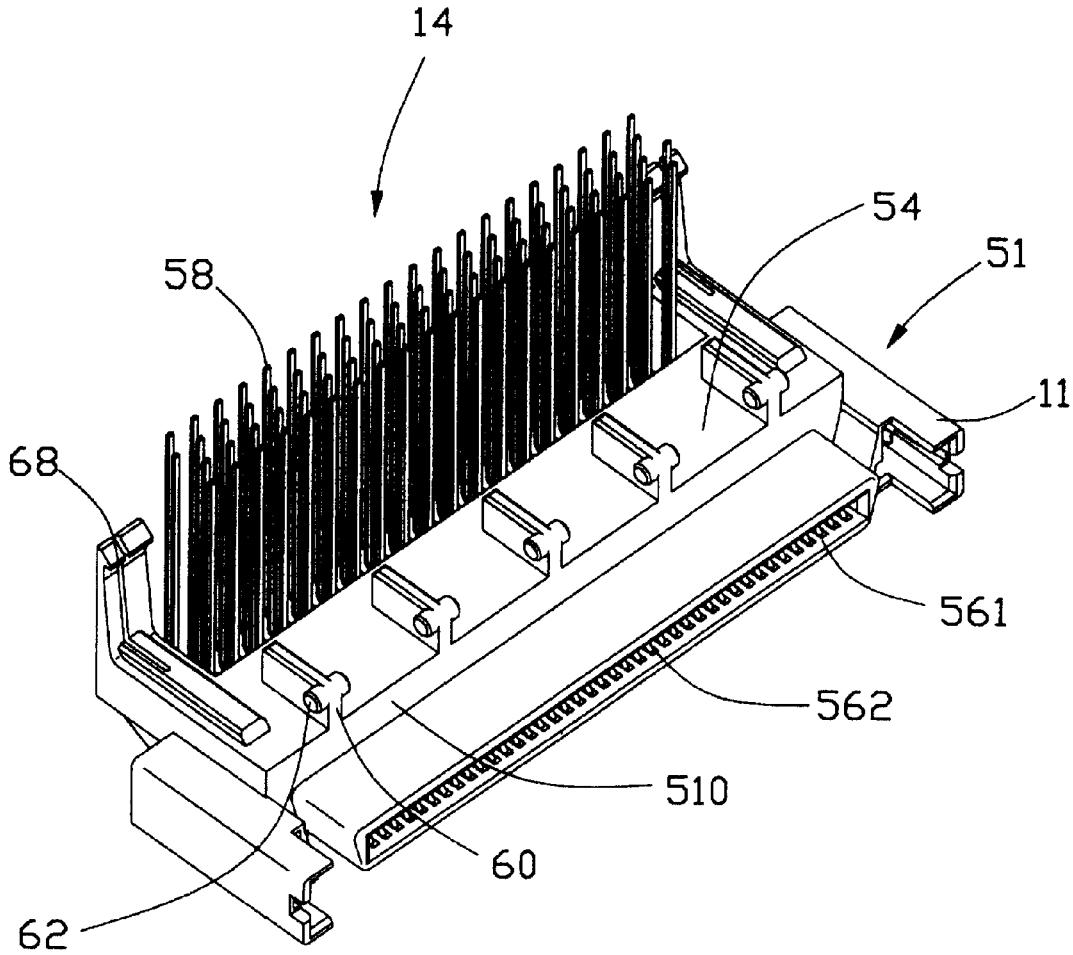
FIG. 5 is a reversed perspective view of a first connector of FIG. 3.

Also referring to FIG. 5, the second housing 51 is formed with a number of projections 60 on the bottom face 54 thereof. Each projection 60 has two oppositely laterally extending pivots 62 at a lower end thereof. The pivots 62 are rotatably fitted in corresponding sockets 48 whereby the second connector 14 is rotatably mounted to the first connector 12 about the pivots 62. The rotatable connection allows relative movement of the second housing 51 with respect to the first housing 16 when the second housing 51 is positioned on the flat top surface 50 of the rib 45 of the first housing 16.

The second housing 51 has two forward-extending arms 11 extending from opposite ends thereof in a forward direction. The mating portion 56 is located between and spaced from the forward-extending arms 24. Each forward-extending arm 11 defines a guide channel 13 for guidingly receiving a complementary guidepost of a second mating connector (not shown) of the complementary stacked SCA-2 connector assembly. A pair of passageways 15 communicate with the corresponding guide channels 13 and extend to the rear face 512 of the second housing 51.

The second housing 51 has rearward-extending arms 64 extending from opposite ends thereof in a rearward direction and corresponding in position to and resting on the rearward-extending arms 34 of the first housing 16. A latch 66 extends downwardly from each rearward-extending arm 64 and is formed with a hook 68 received in and engaged with a lower end of the side plate 41 of the corresponding rearward-extending arm 34 thereby securing the first and second connectors 12, 14 together.

The second terminals 58 are retained in the second housing 51 and are arranged along inner surfaces of the opposite portions of the mating portion 56 for electrically engaging with conductive terminals of the second mating connector. Each second terminal 58 has a second tail 59 extending from the rear face 512 of the second housing 51 and downwardly beyond the bottom face 54 of the second housing 51 for insertion into corresponding holes defined in the printed circuit board.

The grounding member 78 has a base portion 80, a first and a second retention portions 83, 82 parallelly extending forwardly from the base portion 80 and an extension 81 extending forwardly from the base portion 80 above the second retention portion 82. Each of the first and the second retention portion 83, 82 has a plurality of barbs (not labeled) formed on upper and lower edges thereof. The base portion 80 has two spaced, resilient, barbed legs 84 at a lower end thereof. The first retention portion 83 defines an aperture 830 therein. A finger 831 extends rearwardly from a front edge of the aperture 830. The extension 81 has an intermediate portion 812 perpendicularly extending from the base portion 80 and retained between a protrusion 514 and a top face of the rearward-extending arms 64 for preventing upward and downward movements thereof and a front engaging portion 810 perpendicularly extends from an end of the intermediate portion 812.

Figure 9:
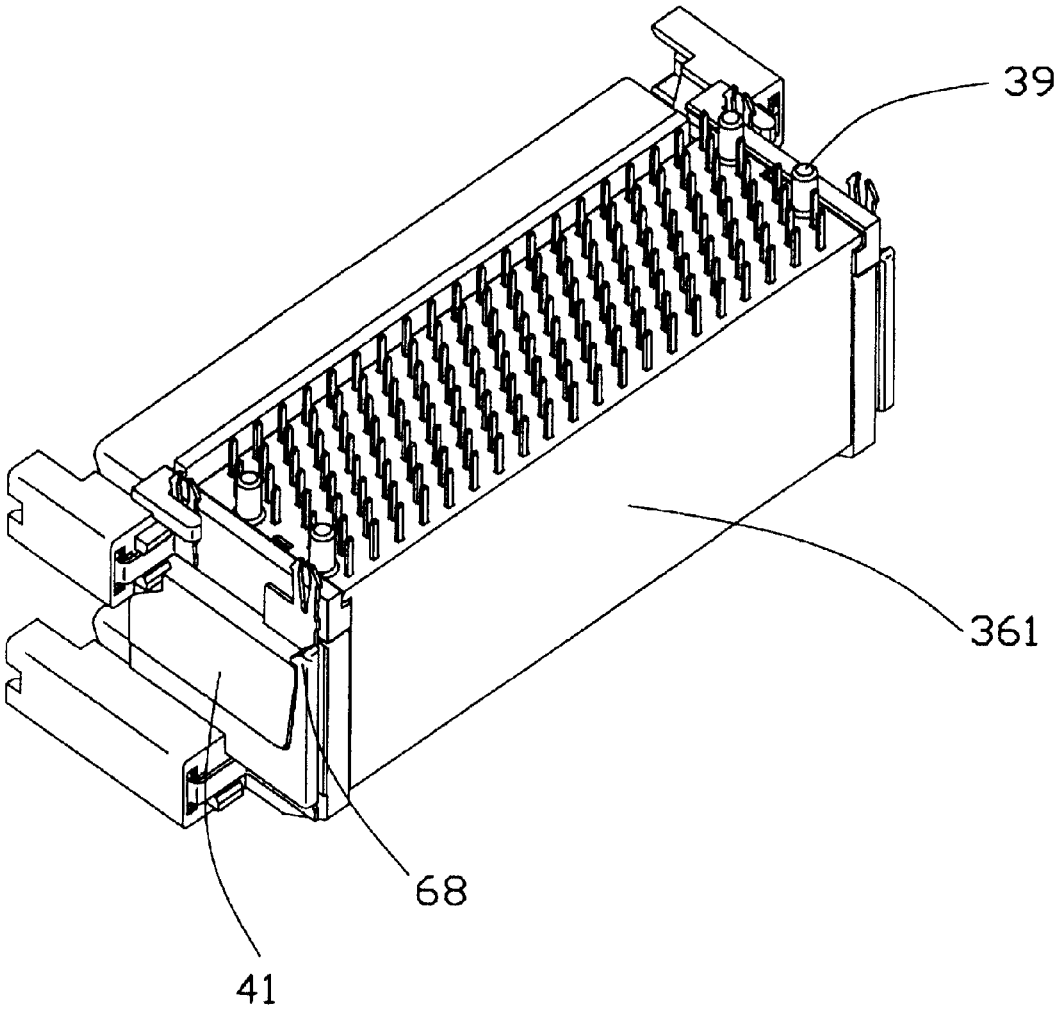
FIG. 9 is a reversed perspective view of FIG. 2.

The spacer 36 has a lower (first) portion 362 defining a plurality of openings 38 extending therethrough and an upper (second) portion 361 defining a plurality of openings 37 extending therethrough. The upper portion 361 is higher than and located behind the lower portion 362. A plurality of posts 39 (shown in FIG. 9) are formed on a bottom face of the spacer 36 for securing the stacked connector assembly 10 onto the printed circuit board.

Referring to FIGS. 5–8, in assembling the first and the second connectors 12, 14 to form the connector assembly 10, when the second connector 14 is oriented to be inclined relative to the first connector 12, the pivots 62 are firstly fitted into the sockets 48 in a front-to-back direction so that the second connector 14 is pivotably mounted on the first connector 12. The second tails 59 of the second terminals 58 of the second connector 14 are partly inserted into the openings 37 of the upper portion 361 of the spacer 36, and the second connector is rotated clockwise to a position in which the bottom face 54 of the second connector rests on the top flat surface 50 of the rib 45 and the openings 38 of the lower portion 362 of the spacer 36 are aligned with the first tails 22 of the first terminals 20 of the first connector 12, and bottom ends of rearward-extending arms 64 abut against the flat surface of the flange 42.

Thereafter, the spacer 36 is moved upwardly until the spacer 36 abuts against the bottom face 17 of the first housing 16, and the first tails 22 of the first terminals 20 extend through the openings 38. The spacer 36 equidistantly spaces the first and the second tails 22, 59 of the first and the second terminals 20, 58, and prevents the tails from buckling when they are inserted into the printed circuit board.

After assembly of the SCA-2 connector assembly 10, the upper slits 641 in the arm 64 are aligned with the lower slits 40 in the arms 34 of the first connector 12. The second retention portions 82 of the grounding members 78 are interferentially received in the upper slit 641 of the second housing 51, and the first retention portions 83 are interferentially received in the lower slit 40 of the first housing 16, and the extension 81 extends into a corresponding passageway 15 of the second housing 51 with the front engaging portion 810 exposed in the guiding channel 13 for mating with a corresponding ground contact of a second mating connector. The spaced, resilient, barbed legs 84 interferentially engage with a hole defined in the printed circuit board in ordinary ways known to persons skilled in the pertinent art. In other words, the grounding member 78 of the present invention also functions as a board lock. Therefore, the grounding members 78 are assembled to the first and second connectors 12, 14 to securely fasten the two connectors together on the printed circuit board.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A stacked connector assembly comprising:

a first connector comprising:

a first housing having a top face; and a plurality of first terminals received in said first housing and each comprising a first tail;

a second connector stacked on the first connector comprising:

a second housing having a bottom face positioned on the top face of the first housing;

a plurality of second terminals received in said second housing and each comprising a second tail; and a grounding member having a front engaging portion projecting forwardly beyond the second housing and adapted for mating with a corresponding ground contact of a complementary electrical connector, a base portion projecting rearwardly beyond the second housing, a first retention portion extending forwardly from the base portion and retained in the first housing, a second retention portion extending forwardly from the base portion and retained in the second housing and a leg projecting downwardly from the base portion beyond the second housing and adapted for being connected with a grounding trace of a printed circuit board; and a spacer having a first portion receiving the first tails of the first terminals therethrough and a second portion receiving the second tails of the second terminals therethrough.

2. The stacked connector assembly as claimed in claim 1, wherein the first housing has opposite ends from which two first rearward-extending arms respectively extend in a rearward direction, each first rearward-extending arm having a side plate and wherein the second housing has opposite ends from which two second rearward-extending arms respectively extend in a rearward direction, a latch depending from each second arm and forming a catch to engage with a bottom end of the side plate.

3. The stacked connector assembly as claimed in claim 2, wherein the first rearward-extending arms correspond in position to the second rearward-extending arms, an upper slit being defined through each latch of the second rearward-extending arms, a lower slit being defined in the corresponding first rearward-extending arm and in registration with the upper slit, the first and the second retention portions received in said lower and upper slits.

4. The stacked connector assembly as claimed in claim 2, wherein the first portion of the spacer is retained between the first rearward-extending arms of the first housing, the second portion of the spacer retained between the second rearward-extending arms of the second housing.

5. The stacked connector assembly as claimed in claim 1, wherein the first retention portion defines an aperture therein, and a finger extending rearwardly from the aperture.

6. The stacked connector assembly as claimed in claim 1, wherein the first housing has opposite ends from which two first forward-extending arms respectively extend in a forward direction, and wherein the second housing has opposite ends from which two second forward-extending arms respectively extend in a forward direction, each forward-extending arms defines a guide channel for receiving the front engaging portion of the grounding member.

7. A stacked connector assembly comprising:

a first connector comprising:

a first housing having a top face; and a plurality of first terminals received in said first housing;

a second connector stacked on the first connector comprising:

a second housing having a bottom face positioned on the top face of the first housing;

a plurality of second terminals received in said second housing; and a grounding member retained in the second housing and having a front engaging portion projecting forwardly beyond the second housing for mating with a corresponding ground contact of a complementary electrical connector and a base portion projecting rearwardly beyond the second housing; and interengaging device arranged between the first housing and the second housing and comprising a first portion formed on the top face of the first housing and a second portion fanned on the bottom face of the second housing, the second portion of the interengaging device being rotatably coupled to the first portion of the interengaging device to hingedly connect the second connector to the first connector.

8. The stacked connector assembly as claimed in claim 7, wherein the base portion of the grounding member has a pair of spaced legs for being compressively inserted into the printed circuit board.

9. The stacked connector assembly as claimed in claim 7, wherein the first and second housings each further comprises a pair of opposite side arms, each defining a guide channel, and wherein the front engaging portion of the rounding member is received in the guide channel.

10. The stacked connector assembly as claimed in claim 7, wherein the first and the second connectors are SCA-2 connectors.

11. The stacked connector assembly as claimed in claim 7, wherein the first portion of the interengaging device comprises a plurality of spaced sockets formed on the top face of the first housing, and wherein the second portion of the interengaging device comprises a plurality of projections extending from the bottom face of the second housing and received in corresponding sockets of the first housing.

12. The stacked connector assembly as claimed in claim 11, wherein each projection has two oppositely laterally extending pivots at a lower end thereof, the pivots rotatably fitted in corresponding sockets whereby the second connector is rotatably mounted to the first connector about the pivots.

13. The stacked connector assembly as claimed in claim 7 further comprising a spacer with a plurality of posts formed on a bottom face thereof for securing the stacked connector assembly on a printed circuit board.

14. A stacked connector assembly comprising;

a first connector defining a top face and a first mating portion extending from a first front face with a plurality of first contacts disposed therein;

a second connector defining a bottom face and a second mating portion extending from a second front face with a plurality of second contacts disposed therein; and hinge means formed on the top face and the bottom face close to said first and second front faces for allowing said first connector and said second connector to be pivotal with each other thereabouts; wherein a vertical distance formed between said first mating portion and said second mating portion when said second connector is filly stacked upon the first connector, is larger than a vertical dimension of at least one of said fist mating portion and said second mating portion, so as to allow the first mating portion and the second mating portion to rotatably move close to each other without interference during rotational assembling.

15. The assembly as claimed in claim 14, wherein said first mating portion and said second mating portion are vertically aligned with each other when said second connector is fully stacked upon said first connector.

* * * * *